US006012910A

United States Patent [19]

McNaull

[11] Patent Number: 6,012,910

[45] Date of Patent: Jan. 11, 2000

[54] ELECTROMAGNETIC OSCILLATING PUMP WITH SELF-ALIGNING SPRINGS

[75] Inventor: Michael H. McNaull, Ashland, Ohio

[73] Assignee: The Gorman-Rupp Company, Bellville, Ohio

[21] Appl. No.: 08/901,156

[22] Filed: Jul. 28, 1997

[51] Int. Cl.[7] ..... F04B 17/04

[52] U.S. Cl. ..... 417/412

[58] Field of Search ..... 417/416, 417, 417/550, 412

[56] References Cited

U.S. PATENT DOCUMENTS

| | | | |
|---|---|---|---|
| 3,136,257 | 6/1964 | Smith et al. | 417/241 |
| 4,824,337 | 4/1989 | Lindner et al. | 417/417 |
| 5,567,131 | 10/1996 | McNaull | 417/417 |

OTHER PUBLICATIONS

The Gorman–Rupp Company advertisement "Oscillating Pumps", 1 page (undated).

Pump Technologies Inc. (PTI) advertisement, 2 pages (undated).

*Primary Examiner*—Timothy S. Thorpe
*Assistant Examiner*—Liem Nguyen
*Attorney, Agent, or Firm*—Renner, Kenner, Greive, Bobak, Taylor & Weber

[57] ABSTRACT

An oscillating pump (10) includes a housing (11) which carries the components thereof. These components include an electromagnetic coil (24) surrounding an armature (23) carried by an impeller (12) which is positioned longitudinally between an inlet area (16) and an outlet area (17) of the pump (10). The armature (23) moves longitudinally upon activation of the coil (24). The impeller (12) includes a pair of bellows (19, 20) and carries a valve (13). The bellows (19, 20) define an inlet chamber (21) and a discharge chamber (22). Another valve (15) is carried by the housing adjacent to the discharge chamber (22). A cup (25) is formed at the inlet end of the impeller (12) and includes a lip (26) defining shoulders (28, 29). The housing (11) is also provided with areas defining shoulders (32, 33). A spring (34) is floatably positioned between the shoulders (28, 33) and another spring (35) is floatingly positioned between the shoulders (29, 32). Upon activation of the coil (24), the valve (13) forces fluid in the discharge chamber (22) through the valve (15) and allows fluid to pass from the inlet chamber (21) to the discharge chamber (22). The return force to move armature (23) in the opposite longitudinal direction is provided primarily by the spring (35) and the springs (34, 35) compensate for any misalignment of the components of the pump (10) during the operation thereof.

8 Claims, 3 Drawing Sheets

ELECTROMAGNETIC OSCILLATING PUMP WITH SELF-ALIGNING SPRINGS

TECHNICAL FIELD

The present invention generally relates to electromagnetically driven oscillating pumps. More particularly, this invention relates to a an oscillating pump with self-aligning springs.

BACKGROUND ART

Electromagnetic oscillating pumps are well known in the art. Typically, an electromagnetic coil is utilized to move an armature carried by an impeller relative to the frame assembly of the pump. Upon energization, a bellows-shaped discharge end of the impeller, defining a discharge chamber, is compressed, thereby decreasing the volume of the discharge chamber. This decrease in volume forces the liquid inside the chamber out of the pump through a one-way discharge valve.

Upon de-energization, a spring or permanent magnet returns the impeller to its original position or beyond, thereby increasing the volume of the discharge chamber. As a result, a partial vacuum is created inside the discharge chamber, and liquid is drawn from an inlet end of the impeller, past a center valve, and into the discharge chamber. The electromagnetic coil is then re-energized and the cycle is repeated, thereby producing a stop-and-go flow in one direction. Oscillations on the order of 60 times per second, however, create a flow that is substantially continuous.

Currently, the oscillating pumps known in the art use fixed springs or a permanent magnet as the opposing force to the electromagnetic forces. McNaull U.S. Pat. No. 5,567,131, for example, discloses an electromagnetic oscillating pump using a spring biased valve and a return spring which is affixed between the armature and the base of the pump to retract the armature. At least one disadvantage to using fixed springs, however, is that each oscillation does not perfectly compress the springs along their axes, thereby increasing the wear and decreasing the life of the springs. In addition, potential spring misalignment may cause increased friction resulting in decreased pump efficiency.

The present invention is advantageous in that it utilizes springs whose ends are not fixed. As a result, the springs automatically adjust to minimize the non-axial forces on the springs, thereby increasing their useful life. Therefore, the need exists for an electromagnetic oscillating pump that has self-aligning springs to provide the return force for the armature.

DISCLOSURE OF THE INVENTION

It is therefore an object of the present invention to provide an electromagnetically driven oscillating pump that will transfer a fluid in an essentially continuous manner.

It is another object of the present invention to provide a pump, as above, that contains self-aligning springs.

It is yet another object of the present invention to provide a pump, as above, in which the springs resist wear and last longer.

It is a further object of the present invention to provide a pump, as above, that is simple and inexpensive to manufacture and maintain.

These and other objects of the present invention, as well as the advantages thereof over existing prior art forms which will become apparent from the description to follow, are accomplished by the improvements hereinafter described and claimed.

In general, an oscillating pump for moving a fluid longitudinally from an inlet area to a discharge area includes a housing having an electromagnetic coil therein. An impeller through which the fluid may pass from the inlet area to the discharge area carries an armature positioned adjacent to the coil. The armature moves in the longitudinal direction upon activation of the coil and the fluid is transferred through the discharge area. A first spring has one end resting against a portion of the housing and the other end resting against the impeller and a second spring is axially aligned with the first spring and has one end resting against another portion of the housing and the other end resting against the impeller. The second spring is compressed upon activation of the coil and the first spring is compressed upon deactivation of the coil, the second spring providing a force to move the armature in a longitudinal direction opposite to the longitudinal direction.

A preferred exemplary oscillating pump incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
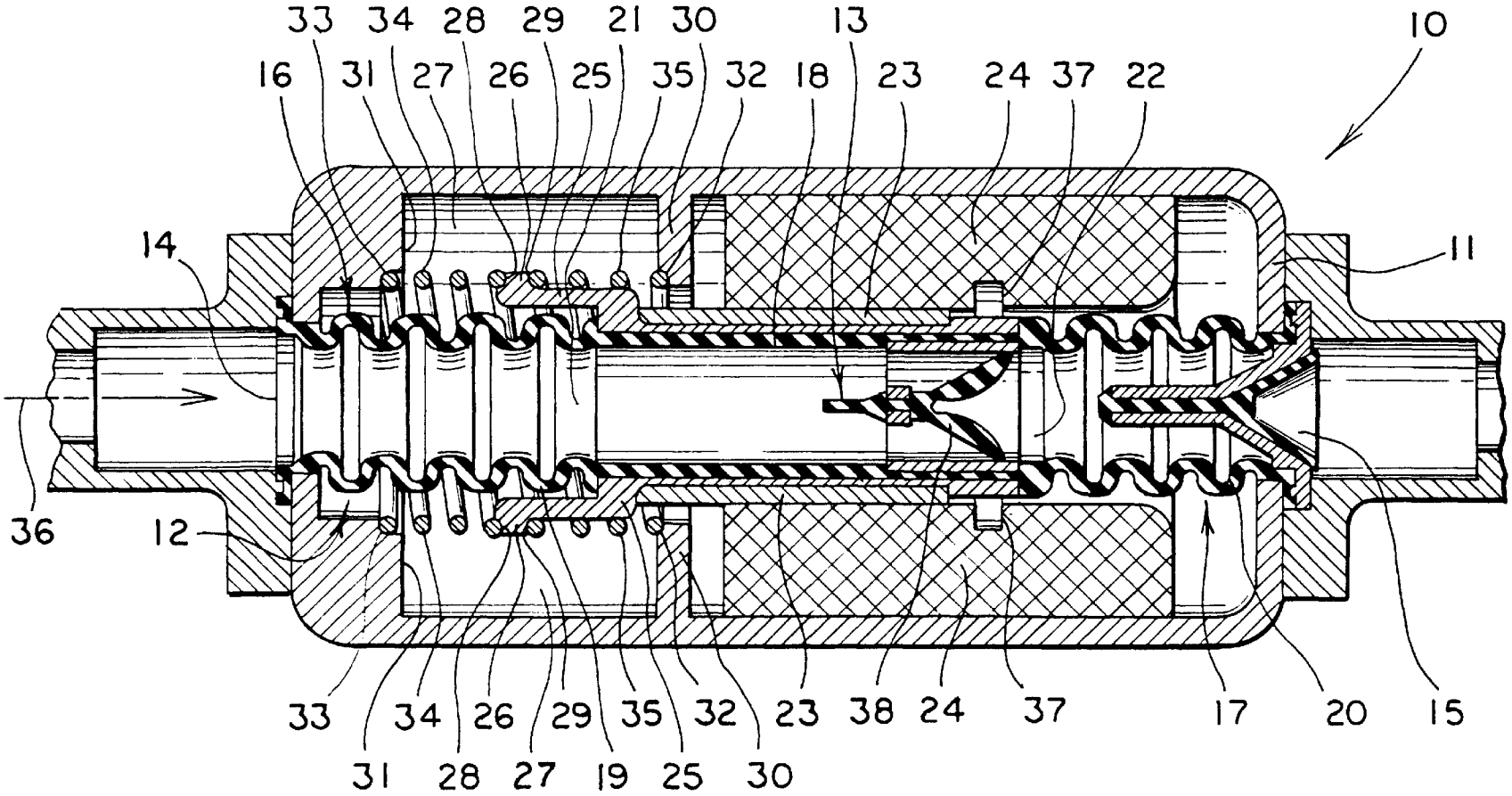
FIG. 1 is a somewhat schematic longitudinal cross section of an oscillating pump according to the present invention showing the pump in the static position.

An oscillating pump according to the present invention is indicated generally in the accompanying drawings by the numeral 10. Pump 10 is designed and works best when positioned directly on a substantially planar surface. Pump 10 includes a housing 11 which may be fabricated from any of a variety of materials, but it has been found that fabricating housing 11 from a hard plastic results in a sturdy device that is relatively easy and inexpensive to manufacture.

An impeller, generally indicated by the numeral 12, is positioned within housing 11 and is a substantially hollow, cylindrical member preferably made from an elastomeric plastic. Impeller 12 carries a center valve 13 which is preferably of the type shown in U.S. Pat. No. 4,824,337, to which reference is made for a complete understanding of this invention. Fluid is permitted to enter impeller 12 longitudinally through inlet 14 and exits through a discharge area which includes a discharge valve 15 carried by housing 11. Discharge valve 15 is preferably a conventional poppet valve. However, a leaf valve, such as the preferred type of center valve 13, could be employed for valve 15 as well.

Impeller 12 includes an inlet area, indicated generally by the numeral 16, and a discharge area, indicated generally by the numeral 17, interconnected by a central portion 18. Inlet area 16 includes a bellows 19, and discharge area 17 includes a similar bellows 20. Bellows 19 is thus adjacent to inlet 14 and bellows 20 is thus adjacent to poppet valve 15, with central portion 18 carrying center valve 13. An inlet chamber 21 is formed within impeller 12 on the inlet side of center valve 13 and a discharge chamber 22 is formed on the discharge side of center valve 13.

Both bellows 19 and bellows 20 are preferably constructed from materials such as an ethylene-propylene terpolymer. The configuration of both bellows 19 and 20 is standard and the number of convolutions is not critical. In the resting or static position, shown in FIG. 1, to decrease stress on impeller 12 when pump 10 is not in use, the load on impeller 12 is preferably small or zero. A slight preload or stretching of impeller 12 can result in a more uniform flow rate or performance.

Central portion 18 of impeller 12 carries a cylindrical armature 23. Armature 23 is circumferentially surrounded by an electromagnetic coil 24. As used herein, "electromagnetic coil 24" is intended to describe a conventional coil and frame assembly available, for example, from Dormeyer Industries, of Chicago, Ill.

The inlet side of the central portion 18 of impeller 12 is provided with a cylindrical cup 25, the end of which turns radially outwardly to form a lip 26 which in the static, FIG. 1, position, is positioned generally centrally of a recess 27 formed within housing 11. Spring-receiving shoulders 28 and 29 are formed on opposite axial sides of lip 26. Housing recess 27 is axially defined by a circumferential rib 30 and an end wall 31 adjacent to inlet 14. Spring receiving shoulders 32 and 33 are formed in rib 30 and end wall 31, respectively.

A coil spring 34 is positioned around bellows 19 between shoulders 33 and 28 and merely rests against shoulders 33 and 28, thereby floating and not in any way being affixed thereto. Similarly, another coil spring 35 is positioned around cup 25 between shoulders 29 and 32 and merely rests against shoulders 29 and 32, thereby floating and not in any way being affixed thereto. Springs 34 and 35 are thus opposing each other and are generally axially aligned with each other and parallel to the axis of impeller 12.

Figure 2:
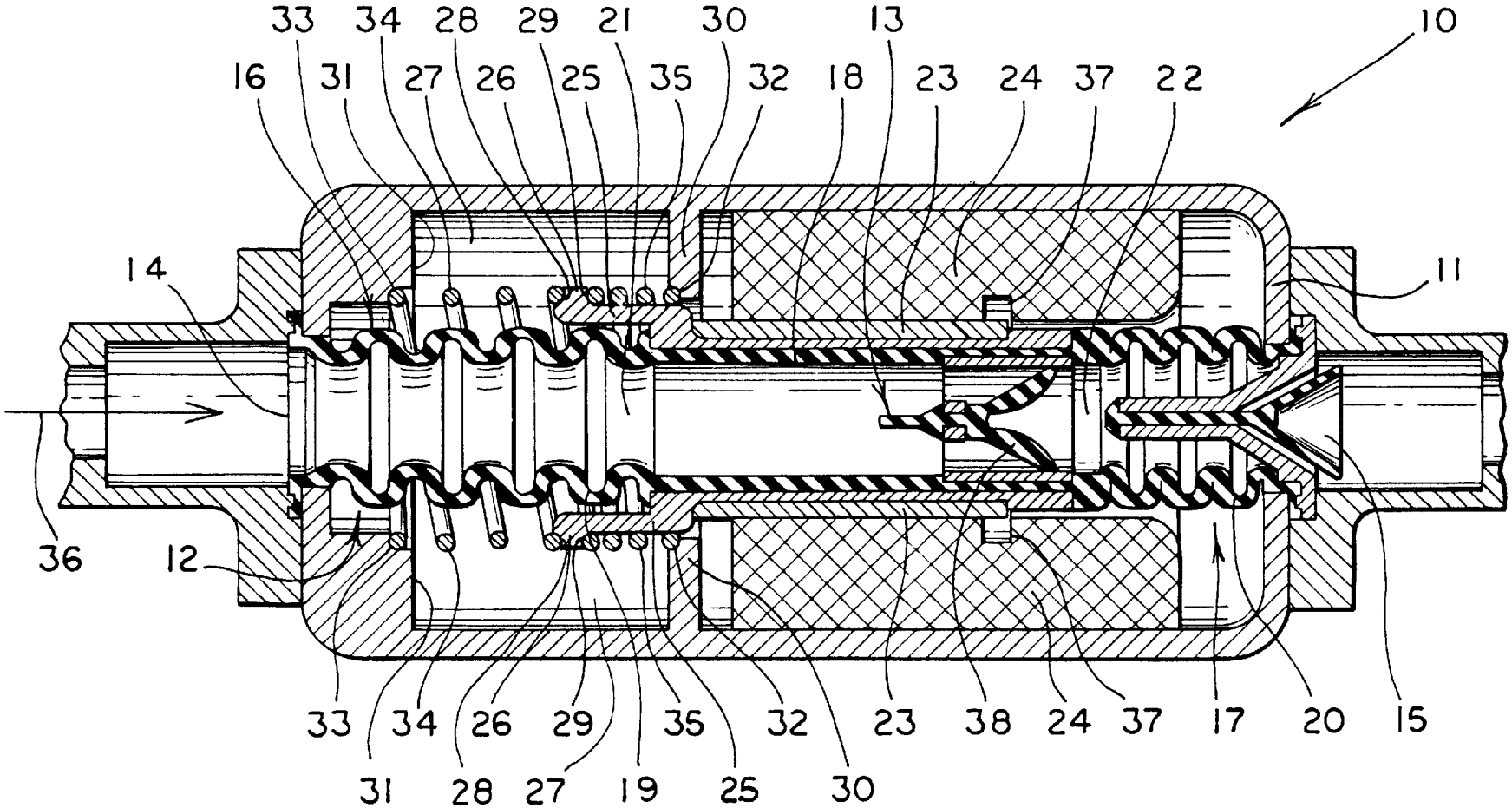
FIG. 2 is a longitudinal cross section similar to FIG. 1 showing the pump near the end of its forward, energized position.

With a conduit attached to each end of pump 10, pump 10 is in condition to pump a fluid in the direction of arrow 36. Upon the energization or activation of coil 24, armature 23 moves in the forward longitudinal direction until the forward-most end of armature 23 becomes approximately aligned, as shown in FIG. 2, with an edge 37 of electromagnetic coil 24, which is the area of greatest magnetic force. One of ordinary skill in the art, however, would realize that the range of travel by the armature is a function of the configuration of the coil. As a result of the change of the position of armature 23, discharge bellows 20 and spring 35 are compressed, and inlet bellows 19 and spring 34 are expanded. As discharge bellows 20 is compressed, the volume of discharge chamber 22 is decreased, and leaves 38 of center valve 13 force fluid in discharge chamber 22 through poppet valve 15 and into an outlet conduit. Simultaneously, inlet bellows 19 expands, thereby increasing the volume of inlet chamber 21 with an attendant decrease in pressure. This decrease in pressure induces additional fluid to enter into inlet chamber 21 through inlet 14.

Figure 3:
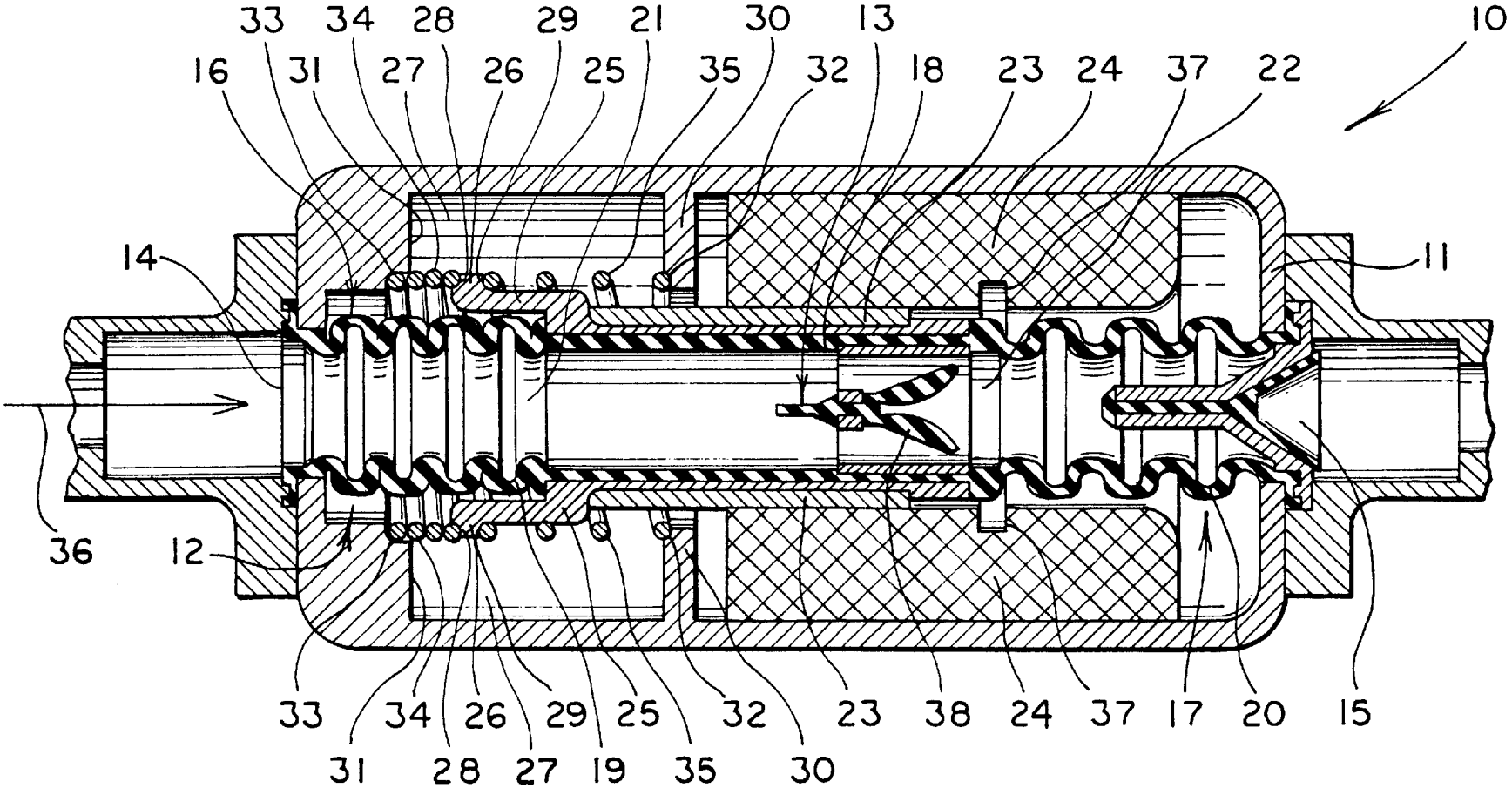
FIG. 3 is a longitudinal cross section similar to FIG. 1 showing the pump near the end of its reverse, de-energized position.

Electromagnetic coil 24 is then de-energized and the force of compressed spring 35 provides a return force such that armature 23 moves past the static position of FIG. 1 to the position shown in FIG. 3. The elastic forces of compressed discharge bellows 20 and expanded inlet bellows 19 may also provide some return force. The return force may to some extent be resisted by spring 34 such that over-return of armature 13 is controlled. As inlet bellows 19 compresses and discharge bellows 20 expands, the pressure in inlet chamber 21 increases and the pressure in discharge chamber 22 decreases, thereby closing poppet valve 15 and forcing fluid from inlet chamber 21, past leaves 38 of center valve 13, and into discharge chamber 22, which fluid is thus available for discharge upon the next energization of coil 24.

It should be understood that the floating arrangement of springs 34 and 35 compensates for any possible misalignment between housing 11 and the components of impeller 12 and armature 23. As such, the requirement for precise manufacturing tolerances in pump 10 are reduced.

It should thus be evident that an electromagnetically driven oscillating pump made in accordance with the concepts of the present invention can be used to pump a fluid utilizing self-aligning springs as the primary force opposing the electromagnetic source. As such, the pump accomplishes the objects of the present invention and otherwise substantially improves the art.

I claim:

1. An oscillating pump for moving fluid longitudinally from an inlet area to a discharge area comprising a housing, an electromagnetic coil in said housing, an impeller including a passage through which the fluid may pass from the inlet area to the discharge area, an armature positioned adjacent to said coil and carried by said impeller such that upon activation of said coil said armature moves in one longitudinal direction thereby transferring fluid through the discharge area, a first spring having one end resting against a portion of said housing and the other end resting against one side of a spring receiving surface of said impeller, and a second spring axially aligned with said first spring and having one end resting against another portion of said housing the other end resting against opposite side of said spring receiving surface of said impeller, said second spring being compressed upon activation of said coil and said first spring being compressed upon deactivation of said coil, said second spring providing a force to move said armature in a longitudinal direction opposite to said one longitudinal direction.

2. An oscillating pump according to claim 1 further comprising a cup formed on the inlet end of said impeller, said cup having shoulders defining said spring receiving surface.

3. An oscillating pump according to claim 2 further comprising a lip formed on said cup, opposed sides of said lip defining said shoulders.

4. An oscillating pump according to claim 2 when said portion of said housing includes a wall having a shoulder formed therein, said shoulder of said wall opposing a said shoulder of said cup, said first spring being positioned between said opposed shoulders.

5. An oscillating pump according to claim 2 wherein said another portion of said housing includes a rib having a shoulder formed therein, said shoulder of said rib opposing a said shoulder of said cup, said second spring being positioned between said opposing shoulders.

6. An oscillating pump according to claim 5 when said portion of said housing includes a wall having a shoulder formed therein, said shoulder of said wall opposing a said shoulder of said cup, said first spring being positioned between said opposed shoulders.

7. An oscillating pump according to claim 1 wherein said impeller includes a first bellows adjacent to the discharge area and a second bellows adjacent to the inlet area, said first bellows compressing and said second bellows expanding upon activation of said coil.

8. A pump according to claim 1 further comprising a first valve carried by said impeller and a second valve carried by said housing, said first valve forcing fluid through the discharge area and through said second valve upon activation of said coil.

* * * * *